US009328456B2

(12) United States Patent
Lai et al.

(10) Patent No.: US 9,328,456 B2
(45) Date of Patent: May 3, 2016

(54) METHOD FOR TREATING TEXTILE WITH ENDOGLUCANASE

(71) Applicant: Novozymes A/S, Bagsvaerd (DK)

(72) Inventors: Weijian Lai, Beijing (CN); Lan Tang, Beijing (CN); Kirk Matthew Schnorr, Holte (DK); Lars Anderson, Malmo (SE)

(73) Assignee: Novozymes A/S, Bagsvaerd (DK)

( * ) Notice: Subject to any disclaimer, the term of this patent is extended or adjusted under 35 U.S.C. 154(b) by 0 days.

(21) Appl. No.: 14/418,209

(22) PCT Filed: Aug. 16, 2013

(86) PCT No.: PCT/CN2013/081600

§ 371 (c)(1),
(2) Date: Jan. 29, 2015

(87) PCT Pub. No.: WO2014/026630

PCT Pub. Date: Feb. 20, 2014

(65) Prior Publication Data

US 2015/0197887 A1 Jul. 16, 2015

Related U.S. Application Data

(60) Provisional application No. 61/697,577, filed on Sep. 6, 2012.

(30) Foreign Application Priority Data

Aug. 16, 2012 (CN) ..... PCT/CN2012/080220

(51) Int. Cl.
*D06M 16/00* (2006.01)

(52) U.S. Cl.
CPC ..... *D06M 16/003* (2013.01)

(58) Field of Classification Search
None
See application file for complete search history.

(56) References Cited

U.S. PATENT DOCUMENTS

2013/0337542 A1* 12/2013 Hill ..... C12N 9/2437
435/209

FOREIGN PATENT DOCUMENTS

| | | | |
|---|---|---|---|
| WO | 96/29397 | A1 | 9/1996 |
| WO | 98/12307 | A1 | 3/1998 |
| WO | 2008/151999 | A1 | 12/2008 |
| WO | 2010/076388 | A1 | 7/2010 |
| WO | 2012/089024 | A1 | 7/2012 |

OTHER PUBLICATIONS

Galagan et al., GenBank Accession No. XP-957107 (2008).

* cited by examiner

*Primary Examiner* — Nashaat Nashed
(74) *Attorney, Agent, or Firm* — Elias Lambiris

(57) ABSTRACT

The present invention relates to the method for manufacturing textile, by treating textile with an isolated polypeptide having endoglucanase activity, especially in biostoning and bio-polishing process.

17 Claims, No Drawings

METHOD FOR TREATING TEXTILE WITH ENDOGLUCANASE

CROSS-REFERENCE TO RELATED APPLICATIONS

This application is a 35 U.S.C. 371 national application of PCT/CN2013/081600 filed Aug. 16, 2013, which claims priority or the benefit under 35 U.S.C. 119 of PCT application no. PCT/CN2012/080220 filed Aug. 16, 2012 and U.S. provisional application No. 61/697,577 filed Sep. 6, 2012. The content of each application is fully incorporated herein by reference.

REFERENCE TO SEQUENCE LISTING

This application contains a Sequence Listing in computer readable form. The computer readable form is incorporated herein by reference.

FIELD OF THE INVENTION

The present invention relates to the method for manufacturing textile, by treating textile with an isolated polypeptide having endoglucanase activity, especially in biostoning and bio-polishing process.

BACKGROUND OF THE INVENTION

Cellulases or cellulytic enzymes are enzymes involved in hydrolyses of cellulose. It is known that there are three major types of cellulase enzymes involved, namely endoglucanase, cellobiohydrolase, and beta-glucosidase.

There is a wide spectrum of industrial applications of cellulases. In the textile industry, cellulases are used in denim finishing to create a fashionable stone washed appearance on denim cloths using a biostoning process. Cellulases are also used, for instance, to clean fuzz and prevent formation of pills on the surface of cotton garments using a biopolishing process.

WO9629397 discloses enzyme preparations with performance in industrial applications such as laundry composition, for biopolishing of newly manufactured textiles, for providing an abraded look of cellulosic fabric or garment, and for treatment of paper pulp. SEQ ID No: 20 in WO9629397 is the partial sequence of *Sordaria fimicola* cellulase.

WO2010/076388 discloses fungal endoglucanases with substantial performance at low temperatures; the endoglucanases are used for treating cellulosic material, especially in textile industry, e.g. in biofinishing or biostoning.

WO2008/151999 discloses a one-step process for combined bleach clean up, biopolishing and dyeing of treating textile in a single bath, wherein the biopolishing step of using cellulase can be performed in the same bath with dyestuff.

There are continued needs in the art for new endoglucanases and methods for obtaining a cellulosic textile fabric with good abrasion effect, and/or reduced tendency to pilling formation in the biopolishing process, especially at low temperature.

The present invention aims to meet these needs.

SUMMARY OF THE INVENTION

The present invention relates to a method for treating textile, by treating textile with an isolated polypeptide having endoglucanase activity selected from the group consisting of:

(a) a polypeptide having at least 80% sequence identity to the mature polypeptide of SEQ ID NO: 2;

(b) a polypeptide encoded by a polynucleotide that hybridizes under medium, medium-high, high, or very high stringency conditions with (i) the mature polypeptide coding sequence of SEQ ID NO: 1, or (ii) the full-length complementary strand of (i);

(c) a polypeptide encoded by a polynucleotide having at least 80% sequence identity to the mature polypeptide coding sequence of SEQ ID NO: 1;

(d) a variant of the mature polypeptide of SEQ ID NO: 2 comprising a substitution, deletion, and/or insertion at one or more (e.g., several) positions; and (e) a fragment of the polypeptide of (a), (b), (c), or (d) that has endoglucanase activity;

wherein the method is conducted under temperature range of 15-65° C.

In one embodiment, the polypeptide is obtained from *Sordaria*, preferably from *Sordaria fimicola*. In one embodiment, the method is conducted under pH range of 4-8.

In one embodiment, the method of treating a textile is a biostoning process.

In some embodiments, the biostoning process may further comprise one or more enzymes selected from the group consisting of proteases, lipases, cutinases, amylases, pectinases, hemicellulases and cellulases.

In some embodiments, the method of treating a textile is a biopolishing process. In some embodiments, the method is conducted with a dyestuff in one bath. In some embodiments, the method is conducted with catalase in one bath.

In some embodiments, the method for treating textile is a method for manufacturing textile. In some embodiments, the textile is manufactured from fabric to garment.

In some embodiments, the textile is a cellulose-containing or cellulosic textile.

The advantage of the present invention is that the method can be conducted in low temperature, such as below 50° C., so as to save energy in textile manufacturing process. The method of the present invention may further show good compatibility with dyeing step.

DETAILED DESCRIPTION OF THE INVENTION

As used herein, the singular forms "a", "an", and "the" include plural references unless the context clearly dictates otherwise. Thus, for example, references to "a peroxidase" include the use of one or more peroxidase. "A step" of a method means at least one step, and it could be one, two, three, four, five or even more method steps.

As used herein, the term "sequential" in relation to a plurality of enzymatic treatments of a textile, means that a second specified enzymatic treatment is performed after a first specified enzymatic treatment is performed. Sequential treatments may be separated by intervening wash steps. Sequential enzymatic treatments are performed "in the same bath or in different baths. "In the same bath" means in substantially the same liquid without intervening washes. Single-bath sequential treatment may include pH adjustments, temperature adjustment, and/or the addition of salts, activators, mediators, and the like between the treatments, but should not include washes or rinses.

As used herein, the term "simultaneous," in relation to a plurality of enzymatic treatments of a textile, means that a second specified enzymatic treatment is performed at the same time (i.e., at least partially overlapping with) as a first specified enzymatic treatment. Simultaneous enzymatic treatments are necessarily performed "in the same bath" without intervening wash steps.

Definitions

Endoglucanase: The term "endoglucanase" means an endo-1,4-(1,3;1,4)-beta-D-glucan 4-glucanohydrolase (E.C. 3.2.1.4), which catalyzes endohydrolysis of 1,4-beta-D-glycosidic linkages in cellulose, cellulose derivatives (such as carboxymethyl cellulose and hydroxyethyl cellulose), lichenin, beta-1,4 bonds in mixed beta-1,3 glucans such as cereal beta-D-glucans or xyloglucans, and other plant material containing cellulosic components. Endoglucanase activity can be determined by measuring reduction in substrate viscosity or increase in reducing ends determined by a reducing sugar assay (Zhang et al., 2006, *Biotechnology Advances* 24: 452-481). Endoglucanase activity can also be determined using carboxymethyl cellulose (CMC) as substrate according to the procedure of part VI in page 264 of Ghose, 1987, *Pure and Appl. Chem.* 59: 257-268.

For purposes of the present invention, endoglucanase activity is determined according to the procedure described in the Examples. In one aspect, the polypeptides of the present invention have at least 50%, at least 60%, at least 70%, at least 80%, at least 90%, at least 95%, or at least 100% of the endoglucanase activity of the mature polypeptide of SEQ ID NO: 2.

Typically, the endoglucanase has at least two functional domains, a carbohydrate binding module (CBM) and a catalytic module. The catalytic module is defined as an amino acid sequence that is capable of enzymatically cleaving cellulose, e.g. has endoglucanase activity. The catalytic module is not considered to be a carbohydrate-binding module. A "linker sequence" connects the two functional modules.

Carbohydrate-binding module: The term "carbohydrate-binding module" (CBM) is defined as an amino acid sequence that binds to a substrate. CBMs are for example described in Boraston et al, Biochem. J. (2004) 382, 769-781 and in Tomme et al., John N. Saddler and Michael H. Penner (Eds.), ACS Symposium Series, No. 618, 1995. It is believed that the CBM binding to the substrate which increases the efficacy of the catalytic active part of the enzyme.

The term CBM is now in general use; however, the term "cellulose-binding domain" (CBD) is used to describe the subset of CBM that bind specifically to cellulose substrate. In context, CBM or CBD of the polypeptide having endoglucanase activity could be used interchangeably.

Family 45 or Family GH45 or CEL45: The term "Family 45" or "Family GH45" or "CEL45" is defined herein as a polypeptide falling into the glycoside hydrolase Family 45 according to Henrissat B., 1991, A classification of glycosyl hydrolases based on amino-acid sequence similarities, *Biochem. J.* 280: 309-316, and Henrissat and Bairoch, 1996, Updating the sequence-based classification of glycosyl hydrolases, *Biochem. J.* 316: 695-696. Carbohydrate binding modules are often associated with catalytic modules encoding enzymes such as glycosyl hydrolases. Guillén D, Sanchez S, Rodríguez-Sanoja R. Carbohydrate-binding domains: multiplicity of biological roles. Applied Microbiology & Biotechnology February 2010; 85(5):1241. Available from: EDS Foundation Index, Ipswich, Mass.

The *Sordaria fimicola* Cel45 cellulase (abbreviated as SfCel45) with mature peptide of SEQ ID NO: 2 (amino acids 22 to 294 of SEQ ID NO: 2). Binding domains are known to bind to and interact with cellulose. It is believed that the carbohydrate binding domain found in the SfCel45 is, in part, responsible for the exceptional performance of the enzyme in the application found in this invention.

Allelic variant: The term "allelic variant" means any of two or more alternative forms of a gene occupying the same chromosomal locus. Allelic variation arises naturally through mutation, and may result in polymorphism within populations. Gene mutations can be silent (no change in the encoded polypeptide) or may encode polypeptides having altered amino acid sequences. An allelic variant of a polypeptide is a polypeptide encoded by an allelic variant of a gene.

cDNA: The term "cDNA" means a DNA molecule that can be prepared by reverse transcription from a mature, spliced, mRNA molecule obtained from a eukaryotic or prokaryotic cell . . . cDNA lacks intron sequences that may be present in the corresponding genomic DNA. The initial, primary RNA transcript is a precursor to mRNA that is processed through a series of steps, including splicing, before appearing as mature spliced mRNA.

Coding sequence: The term "coding sequence" means a polynucleotide, which directly specifies the amino acid sequence of a polypeptide. The boundaries of the coding sequence are generally determined by an open reading frame, which begins with a start codon such as ATG, GTG, or TTG and ends with a stop codon such as TAA, TAG, or TGA. The coding sequence may be a genomic DNA, cDNA, synthetic DNA, or a combination thereof.

Control sequences: The term "control sequences" means nucleic acid sequences necessary for expression of a polynucleotide encoding a mature polypeptide of the present invention. Each control sequence may be native (i.e., from the same gene) or foreign (i.e., from a different gene) to the polynucleotide encoding the polypeptide or native or foreign to each other. Such control sequences include, but are not limited to, a leader, polyadenylation sequence, propeptide sequence, promoter, signal peptide sequence, and transcription terminator. At a minimum, the control sequences include a promoter, and transcriptional and translational stop signals. The control sequences may be provided with linkers for the purpose of introducing specific restriction sites facilitating ligation of the control sequences with the coding region of the polynucleotide encoding a polypeptide.

Expression: The term "expression" includes any step involved in the production of a polypeptide including, but not limited to, transcription, post-transcriptional modification, translation, post-translational modification, and secretion.

Expression vector: The term "expression vector" means a linear or circular DNA molecule that comprises a polynucleotide encoding a polypeptide and is operably linked to control sequences that provide for its expression.

Fragment: The term "fragment" means a polypeptide or a catalytic domain having one or more (e.g., several) amino acids absent from the amino and/or carboxyl terminus of a mature polypeptide or domain; wherein the fragment has endoglucanase activity. In one aspect, a fragment contains at least 85%, 90%, and 95% of the number of amino acids of the mature polypeptide of SEQ ID NO: 2.

High stringency conditions: The term "high stringency conditions" means for probes of at least 100 nucleotides in length, prehybridization and hybridization at 42° C. in 5×SSPE, 0.3% SDS, 200 micrograms/ml sheared and denatured salmon sperm DNA, and 50% formamide, following standard Southern blotting procedures for 12 to 24 hours. The carrier material is finally washed three times each for 15 minutes using 0.2×SSC, 0.2% SDS at 65° C.

Host cell: The term "host cell" means any cell type that is susceptible to transformation, transfection, transduction, or the like with a nucleic acid construct or expression vector comprising a polynucleotide of the present invention. The term "host cell" encompasses any progeny of a parent cell that is not identical to the parent cell due to mutations that occur during replication.

Isolated: The term "isolated" means a substance in a form or environment that does not occur in nature. Non-limiting examples of isolated substances include (1) any non-naturally occurring substance, (2) any substance including, but not limited to, any enzyme, variant, nucleic acid, protein, peptide or cofactor, that is at least partially removed from one or more or all of the naturally occurring constituents with which it is associated in nature; (3) any substance modified by the hand of man relative to that substance found in nature; or (4) any substance modified by increasing the amount of the substance relative to other components with which it is naturally associated (e.g., recombinant production in a host cell; multiple copies of a gene encoding the substance; and use of a stronger promoter than the promoter naturally associated with the gene encoding the substance).

Mature polypeptide: The term "mature polypeptide" means a polypeptide in its final form following translation and any post-translational modifications, such as N-terminal processing, C-terminal truncation, glycosylation, phosphorylation, etc. In one aspect of the present invention, the mature polypeptide is amino acids 22 to 294 of SEQ ID NO: 2, based on SignalP 3.0 program (Bendtsen et al., 2004, *J. Mol. Biol.* 340: 783-795) that predicts amino acids 1 to 21 of SEQ ID NO: 2 are a signal peptide. It is further confirmed by the N-terminal sequencing, showing mature peptide begins with ASGSGK, which is consistent with the prediction that amino acids 1 to 21 of SEQ ID NO: 2 are a signal peptide.

It is known in the art that a host cell may produce a mixture of two of more different mature polypeptides (i.e., with a different C-terminal and/or N-terminal amino acid) expressed by the same polynucleotide. It is also known in the art that different host cells process polypeptides differently, and thus, one host cell expressing a polynucleotide may produce a different mature polypeptide (e.g., having a different C-terminal and/or N-terminal amino acid) as compared to another host cell expressing the same polynucleotide. In one aspect, I would use ranges of amino acids, e.g. the mature peptide may be up to 7, 6, 5, 4, 3, 2 or 1 amino acids longer or shorter than the predicted mature polypeptide, or may constitute a mixture of mature polypeptides with varying length but essentially the same functionality.

Mature polypeptide coding sequence: The term "mature polypeptide coding sequence" means a polynucleotide that encodes a mature polypeptide having endoglucanase activity. In one aspect, the mature polypeptide coding sequence is nucleotides 75 to 893 of SEQ ID NO: 1, and nucleotides 12 to 74 of SEQ ID NO: 1 encode a signal peptide.

Medium stringency conditions: The term "medium stringency conditions" means for probes of at least 100 nucleotides in length, prehybridization and hybridization at 42° C. in 5×SSPE, 0.3% SDS, 200 micrograms/ml sheared and denatured salmon sperm DNA, and 35% formamide, following standard Southern blotting procedures for 12 to 24 hours. The carrier material is finally washed three times each for 15 minutes using 0.2×SSC, 0.2% SDS at 55° C.

Medium-high stringency conditions: The term "medium-high stringency conditions" means for probes of at least 100 nucleotides in length, prehybridization and hybridization at 42° C. in 5×SSPE, 0.3% SDS, 200 micrograms/ml sheared and denatured salmon sperm DNA, and 35% formamide, following standard Southern blotting procedures for 12 to 24 hours. The carrier material is finally washed three times each for 15 minutes using 0.2×SSC, 0.2% SDS at 60° C.

Nucleic acid construct: The term "nucleic acid construct" means a nucleic acid molecule, either single- or double-stranded, which is isolated from a naturally occurring gene or is modified to contain segments of nucleic acids in a manner that would not otherwise exist in nature or which is synthetic, which comprises one or more control sequences.

Operably linked: The term "operably linked" means a configuration in which a control sequence is placed at an appropriate position relative to the coding sequence of a polynucleotide such that the control sequence directs expression of the coding sequence.

Sequence identity: The relatedness between two amino acid sequences or between two nucleotide sequences is described by the parameter "sequence identity".

For purposes of the present invention, the sequence identity between two amino acid sequences is determined using the Needleman-Wunsch algorithm (Needleman and Wunsch, 1970, *J. Mol. Biol.* 48: 443-453) as implemented in the Needle program of the EMBOSS package (EMBOSS: The European Molecular Biology Open Software Suite, Rice et al., 2000, *Trends Genet.* 16: 276-277), preferably version 5.0.0 or later. The parameters used are gap open penalty of 10, gap extension penalty of 0.5, and the EBLOSUM62 (EMBOSS version of BLOSUM62) substitution matrix. The output of Needle labeled "longest identity" (obtained using the -nobrief option) is used as the percent identity and is calculated as follows:

$$(\text{Identical Residues} \times 100)/(\text{Length of Alignment} - \text{Total Number of Gaps in Alignment})$$

For purposes of the present invention, the sequence identity between two deoxyribonucleotide sequences is determined using the Needleman-Wunsch algorithm (Needleman and Wunsch, 1970, supra) as implemented in the Needle program of the EMBOSS package (EMBOSS: The European Molecular Biology Open Software Suite, Rice et al., 2000, supra), preferably version 5.0.0 or later. The parameters used are gap open penalty of 10, gap extension penalty of 0.5, and the EDNAFULL (EMBOSS version of NCBI NUC4.4) substitution matrix. The output of Needle labeled "longest identity" (obtained using the -nobrief option) is used as the percent identity and is calculated as follows:

$$(\text{Identical Deoxyribonucleotides} \times 100)/(\text{Length of Alignment} - \text{Total Number of Gaps in Alignment})$$

Subsequence: The term "subsequence" means a polynucleotide having one or more (e.g., several) nucleotides absent from the 5' and/or 3' end of a mature polypeptide coding sequence; wherein the subsequence encodes a fragment having endoglucanase activity. In one aspect, a subsequence contains at least 749 nucleotides of SEQ ID NO: 1, at least 793 nucleotides of SEQ ID NO: 1, or at least 837 nucleotides of SEQ ID NO: 1.

Variant: The term "variant" means a polypeptide having endoglucanase activity comprising an alteration, i.e., a substitution, insertion, and/or deletion, at one or more (e.g., several) positions. A substitution means replacement of the amino acid occupying a position with a different amino acid; a deletion means removal of the amino acid occupying a position; and an insertion means adding one or more (e.g., several) amino acids, e.g., 1-5 amino acids, adjacent to the amino acid occupying a position.

Very high stringency conditions: The term "very high stringency conditions" means for probes of at least 100 nucleotides in length, prehybridization and hybridization at 42° C. in 5×SSPE, 0.3% SDS, 200 micrograms/ml sheared and denatured salmon sperm DNA, and 50% formamide, following standard Southern blotting procedures for 12 to 24 hours. The carrier material is finally washed three times each for 15 minutes using 0.2×SSC, 0.2% SDS at 70° C.

Textile: The term "textiles" used herein is meant to include fibers, yarns, fabrics and garments.

Fabric can be constructed from fibers by weaving, knitting or non-woven operations. Weaving and knitting require yarn as the input whereas the non-woven fabric is the result of random bonding of fibers (felt can be thought of as non-woven). In the present context, the term "fabric" is also intended to include fibers and other types of processed fabrics.

According to the invention, the method of the invention may be applied to any textile known in the art (woven, knitted, or non-woven). In particular the process of the present invention may be applied to cellulose-containing or cellulosic textile, such as cotton, viscose, rayon, ramie, linen, lyocell (e.g., Tencel, produced by Courtaulds Fibers), or mixtures thereof, or mixtures of any of these fibers together with synthetic fibres (e.g., polyester, polyamid, nylon) or other natural fibers such as wool and silk., such as viscose/cotton blends, lyocell/cotton blends, viscose/wool blends, lyocell/wool blends, cotton/wool blends; flax (linen), ramie and other fabrics based on cellulose fibers, including all blends of cellulosic fibers with other fibers such as wool, polyamide, acrylic and polyester fibers, e.g., viscose/cotton/polyester blends, wool/cotton/polyester blends, flax/cotton blends etc.

DETAILED DESCRIPTION OF THE INVENTION

Polypeptides Having Endoglucanase Activity

The present invention relates to a method for treating textile, by treating textile with an isolated polypeptide having endoglucanase activity selected from the group consisting of:

(a) a polypeptide having at least 80% sequence identity to the mature polypeptide of SEQ ID NO: 2;

(b) a polypeptide encoded by a polynucleotide that hybridizes under medium, medium-high, high, or very high stringency conditions with (i) the mature polypeptide coding sequence of SEQ ID NO: 1, or (ii) the full-length complementary strand of (i);

(c) a polypeptide encoded by a polynucleotide having at least 80% sequence identity to the mature polypeptide coding sequence of SEQ ID NO: 1;

(d) a variant of the mature polypeptide of SEQ ID NO: 2 comprising a substitution, deletion, and/or insertion at one or more (e.g., several) positions; and (e) a fragment of the polypeptide of (a), (b), (c), or (d) that has endoglucanase activity;

wherein the method is conducted under temperature range of 15-65° C.

In the present invention, the isolated polypeptides having endoglucanase activity have sequence identity to the mature polypeptide of SEQ ID NO: 2 of at least 80%, at least 85%, at least 90%, at least 95%, at least 96%, at least 97%, at least 98%, at least 99%, or 100%. In one aspect, the polypeptides differ by up to 10 amino acids, e.g., 1, 2, 3, 4, 5, 6, 7, 8, 9, or 10 from the mature polypeptide of SEQ ID NO: 2.

The polypeptide of the present invention preferably comprises or consists of the amino acid sequence of SEQ ID NO: 2 or an allelic variant thereof; or is a fragment thereof having endoglucanase activity. In another aspect, the polypeptide comprises or consists of the mature polypeptide of SEQ ID NO: 2. In another aspect, the polypeptide comprises or consists of amino acids 22 to 294 of SEQ ID NO: 2.

In one embodiment, the polypeptide is not the fragment of the mature polypeptide of SEQ ID NO: 2 of less than 200 amino acids.

In another embodiment, the polypeptide having endoglucanase activity of the present invention encoded by a polynucleotide that hybridizes under medium stringency conditions, medium-high stringency conditions, high stringency conditions, or very high stringency conditions with (i) the mature polypeptide coding sequence of SEQ ID NO: 1, or (ii) the full-length complement of (i) (Sambrook et al., 1989, *Molecular Cloning, A Laboratory Manual,* 2d edition, Cold Spring Harbor, N.Y.).

The polynucleotide of SEQ ID NO: 1 or a subsequence thereof, as well as the polypeptide of SEQ ID NO: 2 or a fragment thereof, may be used to design nucleic acid probes to identify and clone DNA encoding polypeptides having endoglucanase activity from strains of different genera or species according to methods well known in the art. In particular, such probes can be used for hybridization with the genomic DNA or cDNA of a cell of interest, following standard Southern blotting procedures, in order to identify and isolate the corresponding gene therein. Such probes can be considerably shorter than the entire sequence, but should be at least 15, e.g., at least 25, at least 35, or at least 70 nucleotides in length. Preferably, the nucleic acid probe is at least 100 nucleotides in length, e.g., at least 200 nucleotides, at least 300 nucleotides, at least 400 nucleotides, at least 500 nucleotides, at least 600 nucleotides, at least 700 nucleotides, at least 800 nucleotides, or at least 900 nucleotides in length. Both DNA and RNA probes can be used. The probes are typically labeled for detecting the corresponding gene (for example, with $^{32}P$, $^{3}H$, $^{35}S$, biotin, or avidin). Such probes are encompassed by the present invention.

A genomic DNA or cDNA library prepared from such other strains may be screened for DNA that hybridizes with the probes described above and encodes a polypeptide having endoglucanase activity. Genomic or other DNA from such other strains may be separated by agarose or polyacrylamide gel electrophoresis, or other separation techniques. DNA from the libraries or the separated DNA may be transferred to and immobilized on nitrocellulose or other suitable carrier material. In order to identify a clone or DNA that hybridizes with SEQ ID NO: 1 or a subsequence thereof, the carrier material is used in a Southern blot.

For purposes of the present invention, hybridization indicates that the polynucleotide hybridizes to a labeled nucleic acid probe corresponding to (i) SEQ ID NO: 1; (ii) the mature polypeptide coding sequence of SEQ ID NO: 1; (iii) the full-length complement thereof; or (iv) a subsequence thereof; under very low to very high stringency conditions. Molecules to which the nucleic acid probe hybridizes under these conditions can be detected using, for example, X-ray film or any other detection means known in the art.

In one aspect, the nucleic acid probe is a polynucleotide that encodes the polypeptide of SEQ ID NO: 2; the mature polypeptide thereof; or a fragment thereof. In another aspect, the nucleic acid probe is SEQ ID NO: 1.

In another embodiment, the isolated polypeptide having endoglucanase activity of the present invention is encoded by a polynucleotide having a sequence identity to the mature polypeptide coding sequence of SEQ ID NO: 1 of at least 80%, at least 85%, at least 90%, at least 91%, at least 92%, at least 93%, at least 94%, at least 95%, at least 96%, at least 97%, at least 98%, at least 99%, or 100%.

In another embodiment, the variants of the mature polypeptide of SEQ ID NO: 2 comprising a substitution, deletion, and/or insertion at one or more (e.g., several) positions. In an embodiment, the number of amino acid substitutions, deletions and/or insertions introduced into the mature polypeptide of SEQ ID NO: 2 is up to 10, e.g., 1, 2, 3, 4, 5, 6, 7, 8, 9, or 10. The amino acid changes may be of a minor nature, that is conservative amino acid substitutions or insertions that do not significantly affect the folding and/or activity of the protein; small deletions, typically of 1-30 amino acids; small amino- or carboxyl-terminal extensions, such as an amino-terminal methionine residue; a small linker peptide of up to 20-25 residues; or a small extension that facilitates purification by changing net charge or another function, such as a poly-histidine tract, an antigenic epitope or a binding domain.

Examples of conservative substitutions are within the groups of basic amino acids (arginine, lysine and histidine), acidic amino acids (glutamic acid and aspartic acid), polar amino acids (glutamine and asparagine), hydrophobic amino acids (leucine, isoleucine and valine), aromatic amino acids (phenylalanine, tryptophan and tyrosine), and small amino acids (glycine, alanine, serine, threonine and methionine). Amino acid substitutions that do not generally alter specific activity are known in the art and are described, for example, by H. Neurath and R. L. Hill, 1979, In, *The Proteins*, Academic Press, New York. Common substitutions are Ala/Ser, Val/Ile, Asp/Glu, Thr/Ser, Ala/Gly, Ala/Thr, Ser/Asn, Ala/Val, Ser/Gly, Tyr/Phe, Ala/Pro, Lys/Arg, Asp/Asn, Leu/Ile, Leu/Val, Ala/Glu, and Asp/Gly.

Alternatively, the amino acid changes are of such a nature that the physico-chemical properties of the polypeptides are altered. For example, amino acid changes may improve the thermal stability of the polypeptide, alter the substrate specificity, change the pH optimum, and the like.

Essential amino acids in a polypeptide can be identified according to procedures known in the art, such as site-directed mutagenesis or alanine-scanning mutagenesis (Cunningham and Wells, 1989, *Science* 244: 1081-1085). In the latter technique, single alanine mutations are introduced at every residue in the molecule, and the resultant mutant molecules are tested for endoglucanase activity to identify amino acid residues that are critical to the activity of the molecule. See also, Hilton et al., 1996, *J. Biol. Chem.* 271: 4699-4708. The active site of the enzyme or other biological interaction can also be determined by physical analysis of structure, as determined by such techniques as nuclear magnetic resonance, crystallography, electron diffraction, or photoaffinity labeling, in conjunction with mutation of putative contact site amino acids. See, for example, de Vos et al., 1992, *Science* 255: 306-312; Smith et al., 1992, *J. Mol. Biol.* 224: 899-904; Wlodaver et al., 1992, *FEBS Lett.* 309: 59-64. The identity of essential amino acids can also be inferred from an alignment with a related polypeptide.

Single or multiple amino acid substitutions, deletions, and/or insertions can be made and tested using known methods of mutagenesis, recombination, and/or shuffling, followed by a relevant screening procedure, such as those disclosed by Reidhaar-Olson and Sauer, 1988, *Science* 241: 53-57; Bowie and Sauer, 1989, *Proc. Natl. Acad. Sci. USA* 86: 2152-2156; WO 95/17413; or WO 95/22625. Other methods that can be used include error-prone PCR, phage display (e.g., Lowman et al., 1991, *Biochemistry* 30: 10832-10837; U.S. Pat. No. 5,223,409; WO 92/06204), and region-directed mutagenesis (Derbyshire et al., 1986, *Gene* 46: 145; Ner et al., 1988, *DNA* 7: 127).

Mutagenesis/shuffling methods can be combined with high-throughput, automated screening methods to detect activity of cloned, mutagenized polypeptides expressed by host cells (Ness et al., 1999, *Nature Biotechnology* 17: 893-896). Mutagenized DNA molecules that encode active polypeptides can be recovered from the host cells and rapidly sequenced using standard methods in the art. These methods allow the rapid determination of the importance of individual amino acid residues in a polypeptide.

The polypeptide may be a hybrid polypeptide in which a region of one polypeptide is fused at the N-terminus or the C-terminus of a region of another polypeptide.

The polypeptide may be a fusion polypeptide or cleavable fusion polypeptide in which another polypeptide is fused at the N-terminus or the C-terminus of the polypeptide of the present invention. A fusion polypeptide is produced by fusing a polynucleotide encoding another polypeptide to a polynucleotide of the present invention. Techniques for producing fusion polypeptides are known in the art, and include ligating the coding sequences encoding the polypeptides so that they are in frame and that expression of the fusion polypeptide is under control of the same promoter(s) and terminator. Fusion polypeptides may also be constructed using intein technology in which fusion polypeptides are created post-translationally (Cooper et al., 1993, *EMBO J.* 12: 2575-2583; Dawson et al., 1994, *Science* 266: 776-779).

A fusion polypeptide can further comprise a cleavage site between the two polypeptides. Upon secretion of the fusion protein, the site is cleaved releasing the two polypeptides. Examples of cleavage sites include, but are not limited to, the sites disclosed in Martin et al., 2003, *J. Ind. Microbiol. Biotechnol.* 3: 568-576; Svetina et al., 2000, *J. Biotechnol.* 76: 245-251; Rasmussen-Wilson et al., 1997, *Appl. Environ. Microbiol.* 63: 3488-3493; Ward et al., 1995, *Biotechnology* 13: 498-503; and Contreras et al., 1991, *Biotechnology* 9: 378-381; Eaton et al., 1986, *Biochemistry* 25: 505-512; Collins-Racie et al., 1995, *Biotechnology* 13: 982-987; Carter et al., 1989, *Proteins: Structure, Function, and Genetics* 6: 240-248; and Stevens, 2003, *Drug Discovery World* 4: 35-48.

Source of the Polypeptides of the Present Invention

A polypeptide having endoglucanse activity of the present invention may be obtained from microorganisms of any genus. For purposes of the present invention, the term "obtained from" as used herein in connection with a given source shall mean that the polypeptide encoded by a polynucleotide is produced by the source or by a strain in which the polynucleotide from the source has been inserted. In one aspect, the polypeptide obtained from a given source is secreted extracellularly.

The polypeptide may be a fungal polypeptide. For example, the polypeptide may be a *Sordaria* polypeptide.

In another aspect, the polypeptide is a *Sordaria fimicola* such as *Sordaria fimicola* ATCC 52644, *Sordaria humana*, *Sordaria macrospora*, such as *Sordaria macrospora* ATCC 60255, *Sordaria brevicollis* or *Sordaria papyricola* polypeptide.

It will be understood that for the aforementioned species, the invention encompasses both the perfect and imperfect states, and other taxonomic equivalents, e.g., anamorphs, regardless of the species name by which they are known. Those skilled in the art will readily recognize the identity of appropriate equivalents.

Strains of these species are readily accessible to the public in a number of culture collections, such as the American Type Culture Collection (ATCC), Deutsche Sammlung von Mikroorganismen and Zellkulturen GmbH (DSMZ), Centraalbureau Voor Schimmelcultures (CBS), and Agricultural Research Service Patent Culture Collection, Northern Regional Research Center (NRRL).

The polypeptide may be identified and obtained from other sources including microorganisms isolated from nature (e.g., soil, composts, water, etc.) or DNA samples obtained directly from natural materials (e.g., soil, composts, water, etc.) using the above-mentioned probes. Techniques for isolating microorganisms and DNA directly from natural habitats are well known in the art. A polynucleotide encoding the polypeptide may then be obtained by similarly screening a genomic DNA or cDNA library of another microorganism or mixed DNA sample. Once a polynucleotide encoding a polypeptide has been detected with the probe(s), the polynucleotide can be isolated or cloned by utilizing techniques that are known to those of ordinary skill in the art (see, e.g., Sambrook et al., 1989, supra).

Other Components

In some embodiments of the invention, the bulk solution containing the polypeptide having endoglucanase activity further comprises other components, including without limitation other enzymes, as well as one or more of surfactants, bleaching agents, antifoaming agents, builder systems, and the like, that enhance the biopolishing and/or biostoning process and/or provide superior effects related to, e.g., dyeability and/or wettability. The aqueous solution may also contain dyeing agents.

Other enzymes suitable for use in the present invention include without limitation catalase, proteases, lipases, cutinases, amylases, hemicellulases, pectinases, cellulases and peroxidases/oxidases.

Catalase

In a preferred embodiment, catalases are used in the present invention. The term "catalase" is defined herein as a hydrogen-peroxide: hydrogen-peroxide oxidoreductase (EC 1.11.1.6) that catalyzes the conversion of 2 $H_2O_2$ to $O_2$+2 $H_2O$. For purposes of the present invention, catalase activity is determined according to U.S. Pat. No. 5,646,025.

Non-limiting examples of suitable catalases are disclosed in WO92/17571, CN1563373, US2003100112, EP1336659, US2003074697, U.S. Pat. No. 6,201,167, U.S. Pat. No. 6,022,721, EP931831, JP11046760, WO9317721, WO9309219, JP1086879 and/or JP63003788. Preferred commercially available catalase includes Terminox Ultra, Terminox Supereme (Novozymes A/S); T 100; Oxy-Gone 400 (Genencor International Inc.); Fermcolase 1000, Thermocatalase CTL 200 or JH CT 1800 (Mitsubishi Gas Chemical).

Protease

Suitable proteases include those of animal, vegetable or microbial origin. Microbial origin is preferred. Chemically modified or protein engineered mutants are included. The protease may be a serine protease and metalloprotease, particularly an alkaline microbial protease or a trypsin-like protease. Examples of alkaline proteases are subtilisins, especially those derived from *Bacillus*, e.g., subtilisin Novo, subtilisin Carlsberg, subtilisin 309, subtilisin 147 and subtilisin 168 (described in WO 89/06279). Examples of trypsin-like proteases are trypsin (e.g., of porcine or bovine origin) and the *Fusarium* protease described in WO 89/06270 and WO 94/25583.

Examples of useful proteases are the variants described in WO 92/19729, WO 98/20115, WO 98/20116, and WO 98/34946, especially the variants with substitutions in one or more of the following positions: 27, 36, 57, 76, 87, 97, 101, 104, 120, 123, 167, 170, 194, 206, 218, 222, 224, 235, and 274.

Preferred commercially available protease enzymes include Alcalase™, Savinase™ Primase™, Duralase™, Esperase™, and Kannase™ (Novozymes A/S), Maxatase™, Maxacal™ Maxapem™, Properase™, Purafect™, Purafect OxP™, FN2™, and FN3™ (Genencor International Inc.).

Lipase and Cutinase

Suitable lipases and cutinases include those of bacterial or fungal origin. Chemically modified or protein engineered mutants are included. Examples include lipase from *Thermomyces*, e.g., from *T. lanuginosus* (previously named *Humicola lanuginosa*) as described in EP 258 068 and EP 305 216, cutinase from *Humicola*, e.g. *H. insolens* as described in WO 96/13580, a *Pseudomonas* lipase, e.g., from *P. alcaligenes* or *P. pseudoalcaligenes* (EP 218 272), *P. cepacia* (EP 331 376), *P. stutzeri* (GB 1,372,034), *P. fluorescens, Pseudomonas* sp. strain SD 705 (WO 95/06720 and WO 96/27002), *P. wisconsinensis* (WO 96/12012), a *Bacillus* lipase, e.g., from *B. subtilis* (Dartois et al., 1993, Biochemica et Biophysica Acta, 1131: 253-360), *B. stearothermophilus* (JP 64/744992) or *B. pumilus* (WO 91/16422).

Other examples are lipase variants such as those described in WO 92/05249, WO 94/01541, EP 407 225, EP 260 105, WO 95/35381, WO 96/00292, WO 95/30744, WO 94/25578, WO 95/14783, WO 95/22615, WO 97/04079, WO 97/07202, WO 00/060063, WO2007/087508 and WO 2009/109500.

Preferred commercial lipase products include include Lipolase™, Lipex™; Lipolex™ and Lipoclean™ (Novozymes A/S), Lumafast (originally from Genencor) and Lipomax (originally from Gist-Brocades).

Still other examples are lipases sometimes referred to as acyltransferases or perhydrolases, e.g. acyltransferases with homology to *Candida antarctica* lipase A (WO10/111143), acyltransferase from *Mycobacterium smegmatis* (WO05/56782), perhydrolases from the CE 7 family (WO09/67279), and variants of the *M. smegmatis* perhydrolase in particular the S54V variant used in the commercial product Gentle Power Bleach from Huntsman Textile Effects Pte Ltd (WO10/100028).

Amylase

Suitable amylases include α-amylases and β-amylases, preferably of bacterial or fungal origin. Chemically modified or protein engineered mutants are included. Amylases include α-amylases derived from *Bacillus*, e.g., a special strain of *Bacillus licheniformis*, described in more detail in GB 1,296,839, and variants thereof.

Examples of amylase variants are described in WO 94/02597, WO 94/18314, WO 96/23873, and WO 97/43424, especially the variants with substitutions in one or more of the following positions: 15, 23, 105, 106, 124, 128, 133, 154, 156, 181, 188, 190, 197, 202, 208, 209, 243, 264, 304, 305, 391, 408, and 444.

Commercially available amylases are Stainzyme; Stainzyme Plus; Duramyl™, Termamyl™, Termamyl Ultra; Natalase, Fungamyl™ and BAN™ (Novozymes A/S), Rapidase™ and Purastar™ (from Genencor International Inc.).

Cellulase

Suitable cellulases include complete cellulases or monocomponent endoglucanases of bacterial or fungal origin. Chemically or genetically modified mutants are included. The cellulase may for example be a mono-component or a mixture of mono-component endo-1,4-beta-glucanase often just termed endoglucanases. Suitable cellulases include a fungal cellulase from *Humicola insolens* (U.S. Pat. No. 4,435,307) or from *Trichoderma*, e.g. *T. reesei* or *T. viride*. Examples of cellulases are described in EP 0 495 257. Other suitable cellulases are from *Thielavia* e.g. *Thielavia terrestris* as described in WO 96/29397 or *Fusarium oxysporum* as described in WO 91/17244 or from *Bacillus* as described in, WO 02/099091 and JP 2000210081. Other examples are cellulase variants such as those described in WO 94/07998, EP 0 531 315, U.S. Pat. No. 5,457,046, U.S. Pat. No. 5,686,593, U.S. Pat. No. 5,763,254, WO 95/24471, WO 98/12307. Commercially available cellulases include Celluzyme™, and Carezyme™ (Novozymes A/S), Clazinase™, and Puradax HA™ (Genencor International Inc.), and KAC-500(B)™ (Kao Corporation).

Peroxidase/Oxidase

Suitable peroxidases/oxidases include those of plant, bacterial or fungal origin. Chemically modified or protein engineered mutants are included. Examples of useful peroxidases include peroxidases from *Coprinus*, e.g., from *C. cinereus*, and variants thereof as those described in WO 93/24618, WO 95/10602, and WO 98/15257. Commercially available peroxidases include Guardzyme™ (Novozymes A/S).

Textile Manufacturing Process

The processing of a fabric, such as of a cellulosic material, into material ready for garment manufacture involves several steps: spinning of the fiber into a yarn; construction of woven or knit fabric from the yarn; and subsequent preparation processes, dyeing/printing and finishing operations. Preparation processes are necessary for removing natural and man-induced impurities from fibers and for improving their aesthetic appearance and processability prior to for instance dyeing/printing and finishing. Common preparation processes comprise desizing (for woven goods), scouring, and bleaching, which produce a fabric suitable for dyeing or finishing.

Woven fabric is constructed by weaving "filling" or "weft" yarns between warp yarns stretched in the longitudinal direction on the loom. The warp yarns must be sized before weaving in order to lubricate and protect them from abrasion at the high speed insertion of the filling yarns during weaving. Common size agents are starches (or starch derivatives and modified starches), poly(vinyl alcohol), carboxyl methyl cellulose (i.e. CMC) where starches are dominant. Paraffin, acrylic binders and variety of lubricants are often included in the size mix. The filling yarn can be woven through the warp yarns in a "over one-under the next" fashion (plain weave) or by "over one-under two" (twill) or any other myriad of permutations. Generally, dresses, shirts, pants, sheeting's, towels, draperies, etc. are produced from woven fabric. After the fabric is made, size on the fabric must be removed again (i.e. desizing).

Knitting is forming a fabric by joining together interlocking loops of yarn. As opposed to weaving, which is constructed from two types of yarn and has many "ends", knitted fabric is produced from a single continuous strand of yarn. As with weaving, there are many different ways to loop yarn together and the final fabric properties are dependent both upon the yarn and the type of knit. Underwear, sweaters, socks, sport shirts, sweat shirts, etc. are derived from knit fabrics.

Desizing

Desizing is the degradation and/or removal of sizing compounds from warp yarns in a woven fabric. Starch is usually removed by an enzymatic desizing procedure. In addition, oxidative desizing and chemical desizing with acids or bases are sometimes used.

In some embodiments, the desizing enzyme is an amylolytic enzyme, such as an alphaamylase, a beta-amylase, a mannanase, a glucoamylase, or a combination thereof.

Suitable alpha and beta-amylases include those of bacterial or fungal origin, as well as chemically or genetically modified mutants and variants of such amylases. Suitable alpha-amylases include alpha-amylases obtainable from *Bacillus* species. Suitable commercial amylases include but are not limited to OPTISIZE® NEXT, OPTISIZE® FLEX and OPTISIZE® COOL (all from Genencor International Inc.), and DURAMYL™, ERMAMYL™, FUNGAMYL™ TERMAMYL™, AQUAZYME™ and BAN™ (all available from Novozymes A/S, Bagsvaerd, Denmark).

Other suitable amylolytic enzymes include the CGTases (cyclodextrin glucanotransferases, EC 2.4.1.19), e.g., those obtained from species of *Bacillus, Thermoanaerobactor* or *Thermoanaero-bacterium.*

Scouring

Scouring is used to remove impurities from the fibers, to swell the fibers and to remove seed coat. It is one of the most critical steps. The main purposes of scouring is to a) uniformly clean the fabric, b) soften the motes and other trashes, c) improve fabric absorbency, d) saponify and solubilize fats, oils, and waxes, and e) minimize immature cotton. Sodium hydroxide scouring at about boiling temperature is the accepted treatment for 100% cotton, while calcium hydroxide and sodium carbonate are less frequently used. Synthetic fibers are scoured at much milder conditions. Surfactant and chelating agents are essential for alkaline scouring. Enzymatic scouring has been introduced, wherein cellulase, hemicellulase, pectinase, lipase, and protease are all reported to have scouring effects.

Bleaching

Bleaching is the destruction of pigmented color and/or colored impurities as well as seed coat fragment removal. It is the most critical chemical treatment since a balance between the degrees of whiteness without fiber damage must be maintained. Bleaching is performed by the use of oxidizing or reducing chemistry. Oxidizing agents can be further subdivided into those that employ or generate: a) hypochlorite ($OCl^-$), b) chloride dioxide ($ClO_2$), and hydroperoxide species. Reducing agents are typical sulfur dioxide, hydrosulfite salts, etc. Enzymatic bleaching using glucose oxidase has been reported. Traditionally, hydrogen peroxide is used in this process.

Printing or Dyeing

Printing or dyeing of textiles is carried out by applying dyes (the noun "dye" and "dyestuff" can be used interchangeable in the context) to the textile by any appropriate method for binding the dyestuff to the fibres in the textiles. The dyeing of textiles is for example carried out by passing the fabric through a concentrated solution of dye, followed by storage of the wet fabric in a vapour tight enclosure to permit time for diffusion and reaction of the dye with the fabric substrate prior to rinsing off un-reacted dye. Alternatively, the dye may be fixed by subsequent steaming of the textile prior to rinsing. Excess soluble dyestuff not bound to the fibres must be removed after dyeing to ensure fastness of the dyed textiles and to prevent unwanted dye transfer during laundering of the textile by the consumer. An enzymatic process for removal of excess dye from dyed fabric with a rinse liquor comprising at least one peroxidase, an oxidase agent and at least one mediator, such as liquor comprising a peroxidase, hydrogen peroxidise and a mediator like 1-hydroxy-benzotriazole is disclosed in WO99/34054.

In a typical dyeing process for a bleached cotton fabric, the dyestuff is added firstly in the bath with the appropriate pH and temperature within a period of time, for example 10 mins, and then incubated for a period of time like 30 minutes, followed by slowly adding salts like NaCl or $Na_2SO_4$ within 20 minutes and then incubated for another 10-20 minutes to achieve accelerated and even dyeing; later $Na_2CO_3$ and/or NaOH is added into the bath and maintained at a proper temperature for about 60 min to fix the dye; later the dyeing bath is drained off and the dyed fabric is rinsed with fresh water, neutralized with acid and then soaped at 95° C., 10 min for two times, washed with hot water and then washed with cold water to finish the dyeing process. To combine cellulase in the dyeing process, the cellulase enzyme can be added prior to or simultaneously with the dyesfuff when the temperature/pH conditions were appropriate. For the fabrics just bleached with $H_2O_2$, cellulase and catalase can be added simultaneously into the treating solution and once the residual $H_2O_2$ is cleaned up, dyestuff can be filled immediately.

The dyes include synthetic and natural dyes. Typical dyes are those with anionic functional groups (e.g. acid dyes, direct dyes, Mordant dyes and reactive dyes), those with cationic groups (e.g. basic dyes), those requiring chemical reaction before application (e.g. vat dyes, sulphur dyes and azoic dyes), disperse dyes and solvent dyes. Preferably, suitable dyes for use in the present invention include dyes with anionic functional groups and dyes with cationic groups, more preferably reactive dyes. More preferably, the reactive dyes are vinyl sulfone type dyes, monochlorotriazinyl type dyes or bifunctional reactive dyes, such as Reactive Black 5, Reactive Red 195, Reactive Yellow 3RF and Reactive Red 3BF, etc.

The method of the present invention shows good compatibility with dyeing step. For example, the endoglucanase of the present invention maintains the similar level of pilling note when used together with salt (such as NaCl or $Na_2SO_4$) under conditions as specified in Example 7, compared with the pilling note when the endoglucanase is used alone. Preferably, the pilling note from using endoglucanse in combination with salt is no less than that when the endoglucanase is used alone. More preferably, when the polypeptide having endoglucanase activity of the present invention is used together with the dyestuff of 5% Black 5 and 80 g/L $Na_2SO_4$ under conditions as specified in Example 7, the pilling note maintains at least 80%, more preferably 85% as the pilling note when the same endoglucanase is used without dyestuff and salt.

More preferably, the endoglucanase of the present invention maintains at least 80%, or at least 85%, or at least 90%, or at least 92% pilling note when used together with both $Na_2SO_4$ and 5% Black 5 under conditions as specified in Example 7, compared with the pilling note when the endoglucanase is used alone.

Biopolishing

As used herein, the term "biopolishing", "depilling" and "anti-pilling" are interchangeable.

Most cotton fabrics and cotton blend fabrics have a handle appearance that is rather hard and stiff without the application of finishing components. The fabric surface also is not smooth because small fuzzy microfibrils protrude from it. In addition, after a relatively short period of wear, pilling appears on the fabric surface thereby giving it an unappealing, worn look.

Biopolishing is a method to treat cellulosic fabrics during their manufacture by enzymes such as cellulases, which improves fabric quality with respect to "reduced pilling formation". The most important effects of biopolishing can be characterized by less fuzz and pilling, increased gloss/luster, improved fabric handle, increased durable softness and/or improved water absorbency. Biopolishing usually takes place in the wet processing of the manufacture of knitted and woven fabrics or garments. Wet processing comprises such steps as e.g., desizing, scouring, bleaching, washing, dying/printing and finishing. Biopolishing could be performed as a separate step after any of the wetting steps or in combination with any of those wetting steps, such as in combination with catalase bleaching step and/or in combination with dyeing step.

Manufacturing of Denim Fabric

Some dyed fabric such as denim fabric, requires that the yarns are dyed before weaving. For denim fabric, the warp yarns are dyed for example with indigo, and sized before weaving. Preferably the dyeing of the denim yarn is a ring-dyeing. A preferred embodiment of the invention is ring-dyeing of the yarn with a vat dye such as indigo, or an indigo-related dye such as thioindigo, or a sulfur dye, or a direct dye, or a reactive dye, or a naphthol. The yarn may also be dyed with more than one dye, e.g., first with a sulphur dye and then with a vat dye, or vice versa.

Preferably, the yarns undergo scouring and/or bleaching before they are dyed, in order to achieve higher quality of denim fabric. In general, after woven into dyed fabric, such as denim, the dyed fabric or garment proceeds to a desizing stage, preferably followed by a biostoning step and/or a color modification step.

The desizing process as used herein is the same process as mentioned above in the context.

After desizing, the dyed fabric undergoes a biostoning step if a worn look is desired. The biostoning step can be performed with enzymes or pumice stones or both. As used herein, the term "biostoning", "stone washing" and "abrasion" are interchangeable, which means agitating the denim in an aqueous medium containing a mechanical abrasion agent such as pumice, an abrading cellulase or a combination of these, to provide a "stone-washed" look. In all cases, mechanical action is needed to remove the dye, and the treatment is usually carried out in washing machines, like drum washers, belly washers. As a result of uneven dye removal there are contrasts between dyed areas and areas from which dye has been removed, this appears as a localized variation of colour density. Treatment with cellulase can completely replace treatment with pumice stones. However, cellulase treatment can also be combined with pumice stone treatment, when it is desired to produce a heavily abraded finish.

Biostoning is generally followed by the third step, after-treatment which generally includes washing and rinsing steps during which detergents, optical brighteners, bleaching agents or softeners may be used.

The method for manufacturing textile of the present invention, by treating textile with an isolated polypeptide having endoglucanase activity as defined in the present invention can be applied to a biostoning process.

In another embodiment, the invention provides a denim manufacturing process, which comprises: a) desizing of the denim fabric; b) biostoning the denim with a polypeptide having endoglucanase activity of the present invention; c) rinsing.

The process of the invention may be carried out at conventional conditions in a washing machine conventionally used for stone-washing, e.g., a washer-extractor, belly washer, etc. The enzyme of the invention should be added in an effective amount.

Enzyme Composition for Textile Treatment

The present invention further relates to enzyme composition for textile treatment comprising one or more polypeptide as defined in the present invention.

The textile composition may be adapted for specific uses, such as biostoning or biopolishing, which can provide at least one of the textile benefits such as reduced pilling formation, reduced weight loss of fabric, increased abrasion effect, and low backstaing level.

The textile composition may further include one or more of the enzymes selected from the group consisting of catalase, proteases, lipases, cutinases, amylases, hemicellulases, pectinases, cellulases and peroxidases/oxidases.

The textile composition typically comprises conventional ingredients including without limitation other enzymes, as well as surfactants, stabilizer, wetting agent, dispersing agents, antifoaming agents, lubricants, builder systems, and the like, or a mixture thereof, that provide superior effects related to, e.g., strength, resistance to pilling, water absorbency, and dyeability. The textile composition can be in any form, such as a solid, liquid, paste, gel or any combination thereof.

Process Conditions

Preferably, in the present invention, the method of treating textile with an isolated polypeptide having endoglucanase activity is applied in a biostoning or a biopolishing process. All process conditions below are applicable for both biostoning process and biopolishing process.

It is at present advised that a suitable liquor/textile ratio to be used in the present method may be in the range of from about 20:1 to about 1:1, preferably in the range of from about 15:1 to about 3:1, more preferably in the range of from 15:1 to 5:1 (Volume/weight, ml/g).

In conventional "biostoning" or "biopolishing" processes, the reaction time is usually in the range of from about 10 minutes to about 16 hours. Preferably the reaction time is within the range of from about 20 minutes to about 180 minutes, more preferably the reaction time is within the range of from about 30 minutes to about 120 minutes.

The pH of the reaction medium greatly depends on the enzyme(s) in question. Preferably the process of the invention is carried out at a pH in the range of from about pH 4 to about pH 8, preferably in the range of from about pH 5 to about pH 7.5, or within the range of from about pH 5.5 to about pH 7.0.

The process of the present invention is able to function at a temperature below 60° C., preferably below 50° C., more preferably below 45° C., more preferably below 40° C., even more preferably below 35° C., even more preferably below 30° C., even more preferably below 25° C.

In some embodiments, the process of the present invention is conducted at the temperature range of 15-65° C., preferably 15-45° C., preferably 20-60° C., preferably 20-55° C., preferably 20-45° C., preferably 20-40° C., more preferably 25-55° C., more preferably 25-50° C., more preferably 25-45° C., more preferably 25-35° C., and even more preferably 30-45° C.

Enzyme dosage greatly depends on the enzyme reaction time and enzyme activity, i.e. a relatively short enzymatic reaction time or low enzymatic activity necessitates a relatively increased enzyme dosage, and vice versa. In general, enzyme dosage may be stipulated in accordance with the reaction time available.

The amount of polypeptide with endoglucanse activity to be used according to the method of the present invention depends on many factors. According to the invention the concentration of the polypeptide of the present invention in the aqueous medium may be from about 0.001 to about 10 milligram (mg) enzyme protein per gram (g) of fabric, preferably 0.02-5 milligram of enzyme protein per gram of fabric, more preferably 0.03-3 milligram of enzyme protein per gram of fabric.

In some embodiments, the method for treating textile comprises (a) contacting a textile with a catalase after textile bleached with $H_2O_2$; (b) contacting the textile with a polypeptide having endoglucanase activity of the present invention. In some embodiments, between step (a) and (b), there is a wash step. In some embodiments, (a) and (b) are performed in the same bath without intervening wash steps to remove hydrogen peroxide and achieve biopolishing effect. In some embodiments, (a) and (b) are performed sequentially or simultaneously in the same bath. In some embodiments, (a) and (b) are performed sequentially in a single bath, wherein (a) is performed prior to the (b). In some embodiment, after step b), a dyestuff is added into the aqueous solution and incubating the textile for a sufficient time to achieve dyed textile.

In some embodiments, the method for treating textile comprises (i) simultaneously or sequentially adding a polypeptide having endoglucanase activity of the present invention and a dyestuff to the solution containing the textile and incubating the textile for a sufficient time, and (ii) supplementing the aqueous solution with salt, such as NaCl and $Na_2SO_4$.

In some embodiment, the endoglucanse of the present invention is added prior to the dyestuff.

In some embodiment, the textile is incubated for 10 minutes to 1 hour, preferable 20-50 minutes, more preferably 30-40 minutes after adding a polypeptide having endoglucanase activity and dyestuff.

In some embodiment, after step (ii) of adding salt, the textile is incubated for 20-50 min.

In some embodiment, the method comprises step (iii) of adding $Na_2CO_3$ and/or NaOH into the bath to fix the dyestuff.

The present methods and compositions are further described in the following numbered paragraphs.

1. A method for treating textile with an isolated polypeptide having endoglucanase activity selected from the group consisting of:
   (a) a polypeptide having at least 80% sequence identity to the mature polypeptide of SEQ ID NO: 2;
   (b) a polypeptide encoded by a polynucleotide that hybridizes under medium, medium-high, high, or very high stringency conditions with (i) the mature polypeptide coding sequence of SEQ ID NO: 1, or (ii) the full-length complementary strand of (i);
   (c) a polypeptide encoded by a polynucleotide having at least 80% sequence identity to the mature polypeptide coding sequence of SEQ ID NO: 1;
   (d) a variant of the mature polypeptide of SEQ ID NO: 2 comprising a substitution, deletion, and/or insertion at one or more (e.g., several) positions; and
   (e) a fragment of the polypeptide of (a), (b), (c), or (d) that has endoglucanase activity;
   (f) wherein the method is conducted under temperature range of 15-65° C.

2. In some embodiments of the method of paragraph 1, wherein the polypeptide having endoglucanase activity has at least 80%, at least 85%, at least 90%, at least 95%, at least 96%, at least 97%, at least 98%, at least 99%, or 100% sequence identity to the mature polypeptide of SEQ ID NO: 2, 3. In some embodiments of the method of paragraph 1, wherein the polypeptide having endoglucanase activity comprises a substitution, deletion, and/or insertion of 10 or 9 or 8 or 7 or 6 or 5 or 4 or 3 or 2 or 1 amino acids of the mature polypeptide of SEQ ID NO: 2.

4. In some embodiments of the method of any of paragraphs 1-3, wherein the polypeptide having endoglucanase activity is obtained from *Sordaria*, preferably from *Sordaria fimicola*.

5. In some embodiments of the method of any of paragraphs 1-4, wherein the fragment of SEQ ID NO: 2 is no less than 200 amino acids, preferably no less than 220 amino acids.

6. In some embodiments of the method of any of paragraphs 1-5, wherein the method is conducted under a temperature range of 15-65° C., preferably 15-45° C., more preferably 20-40° C., more preferably 25-35° C.

7. In some embodiments of the method of any of paragraphs 1-6, wherein the method is conducted under pH 4 to about pH 8, preferably in the range of from about pH 5 to about pH 7.5, or within the range of from about pH 5.5 to about pH 7.0.

8. In some embodiments of the method of any of paragraphs 1-7, wherein the method is applied in a biopolishing process.

9. In some embodiments of the method of any of paragraphs 1-8, wherein before the textile was treated with an isolated polypeptide having endoglucanase activity, the method further comprises the step of contacting a textile with a catalase.

10. In some embodiments of the method of paragraph 9, wherein the step of contacting a textile with a catalase, and the step of treating textile with an isolated polypeptide having endoglucanase activity are performed sequentially or simultaneously in the same bath.

11. In some embodiments of the method of any of paragraphs 1-10, wherein the method further comprises the step of adding a dyestuff into the same solution containing the textile.

12. In some embodiments of the method of paragraph 11, wherein the dyestuff and the polypeptide having endoglucanase activity are added sequentially or simultaneously into the same bath containing textile.

13. In some embodiments of the method of paragraph 12, wherein the polypeptide having endoglucanase activity is added prior to the dyestuff.

14. In some embodiments of the method of any of paragraphs 11-13, wherein the method further comprises the step of incubating the textile for 10 minutes to 1 hour, preferable 20-50 minutes, more preferably 30-40 minutes after adding a dyestuff, and later supplementing the solution with salt.

15. In some embodiments of the method of any of paragraphs 8-14, wherein the method is conducted under a temperature range of 15-65° C., preferably 15-45° C., more preferably 20-40° C., more preferably 25-35° C.

16. In some embodiments of the method of any of paragraphs 8-15, wherein the method is conducted under pH 4 to about pH 8, preferably in the range of from about pH 5 to about pH 7.5, or within the range of from about pH 5.5 to about pH 7.0.

17. In some embodiments of the method of any of paragraphs 14-16, wherein the salt is NaCl or $Na_2SO_4$.

18. In some embodiments of the method of any of paragraphs 11-17, wherein the dyestuff is a reactive dye.

19. In some embodiments of the method of paragraph 18, wherein when the polypeptide having endoglucanase activity is used together with the dyestuff of 5% Black 5 and 80 g/L $Na_2SO_4$ under conditions as specified in Example 7, the pilling note maintains at least 80%, more preferably 85% as the pilling note when the same endoglucanase is used without dyestuff and salt.

20. In some embodiments of the method of any of paragraphs 1-7, wherein the method is applied in a biostoning process.

21. In some embodiments of the method of paragraphs 20, wherein the method further comprises one or more enzymes selected from the group consisting of catalases, proteases, lipases, cutinases, amylases, hemicellulases, pectinases, cellulases and peroxidases.

22. In some embodiments of the method of paragraphs 20, wherein before the textile was treated with an isolated polypeptide having endoglucanase activity, the method further comprises the step of desizing the fabric.

23. In some embodiments of the method of any of preceding paragraphs, wherein the treating textile is manufacturing the textile.

The present invention is further described by the following examples that should not be construed as limiting the scope of the invention.

EXAMPLES

Materials

Chemicals used as buffers and substrates were commercial products of at least reagent grade. The dyestuff reactive black 5 and reactive red 195 were bought from Argus, China.

Media

COVE-sorbitol plates were composed of 182 g sorbitol (Sigma 85529 Bio ultra 99.5% pure; Sigma-Aldrich Denmark A/S, Copenhagen, Denmark), 20 g of agar powder, 20 ml of COVE salts solution, and deionized water to 1 liter. The medium was sterilized by autoclaving at 15 psi for 15 minutes (Bacteriological Analytical Manual, 8th Edition, Revision A, 1998). The medium was cooled to 60° C. and 10 mM acetamide, 15 mM CsCl, TRITON® X-100 (50 μl/500 ml) were added.

COVE salts solution was composed of 26 g of $MgSO4.7H_2O$, 26 g of KCl, 26 g of $KH_2PO_4$, 50 ml of COVE trace metals solution, and deionized water to 1 liter.

COVE trace metals solution was composed of 0.04 g of $Na_2B_4O_7.10H_2O$, 0.4 g of $CuSO4.5H_2O$, 1.2 g of $FeSO_4.7H_2O$, 0.7 g of $MnSO_4.H_2O$, 0.8 g of $Na_2MoO_4.2H_2O$, 10 g of $ZnSO_4.7H_2O$, and deionized water to 1 liter.

pH 6.5 buffer with 50 mM phosphate: 5.642 g disodium hydrogen phosphate dodecahydrate ($Na_2HPO_4.12H_2O$) and 5.344 g sodium dihydrogen phosphate dehydrate ($NaH_2PO_4.2H_2O$) were dissolved in 1 L de-ionized water. For buffers containing salts, 80 g sodium sulphate ($Na_2SO_4$) or 80 g sodium chloride (NaCl) was dissolved together with disodium hydrogen phosphate dodecahydrate and sodium dihydrogen phosphate dehydrate as above in 1 L de-ionized water and the pH was checked.

pH 5.0 buffer with 50 mM acetate: 2.873 g sodium acetate and 0.901 g acetic acid were dissolved in 1 L de-ionized water;

pH 6.0 buffer with 50 mM phosphate: 2.20 g disodium hydrogen phosphate dodecahydrate ($Na_2HPO_4.12H_2O$) and 6.84 g sodium dihydrogen phosphate dehydrate ($NaH_2PO_4.2H_2O$) were dissolved in 1 L de-ionized water;

pH 7.5 buffer with 50 mM phosphate: 15.05 g disodium hydrogen phosphate dodecahydrate ($Na_2HPO_4.12H_2O$) and 1.25 g sodium dihydrogen phosphate dehydrate ($NaH_2PO_4.2H_2O$) were dissolved in 1 L de-ionized water.

Enzymes

Cellusoft CR® (a mono-component *Thielavia terrestris* GH45 endoglucanase product, commercially available from Novozymes A/S, described in WO96/29397)

Biotouch XC 300® (a neutral cellulase product, commercially available from AB Enzymes, described as SEQ ID NO:13 Geomyces pannorum RF6293 Cel45A in WO2010/076388)

Fabrics

Cotton interlock: 40S, bleached, HM-A0008, available from HM Cotton Co., Ltd, Guangzhou, China.

Method

Weight Loss Determination

The swatches were placed in the conditioned room (65%+/−5% humidity, 21+/−1° C.) for 24 hours before they were numbered, weighed by the analytical balance (for samples below 100 g) recorded. After treatment, all samples were tumbled dried (AEG, LAVATHERM 37700, Germany) for 1 hour and conditioned for 24 hours in the conditioned room mentioned as above. For each sample, the weight loss was defined as below:

$$\text{Weight loss } \% = \frac{(\text{weight before} - \text{weight after}) * 100}{\text{weight before treatment}}$$

Pilling Notes Test

Fabrics including treated and untreated which had been pre-conditioned in norm climate (65% humidity, 21° C.) for at least 24 hours were tested for the pilling notes with Nu-Martindale Tester (James H. Heal Co. Ltd, England), with untreated fabrics of the same type as the abraded fabrics. A standard pilling test (Swiss Norm (SN) 198525) was carried out after 2000 Revolutions by marking from 1-5, with the meaning defined as below, where 1 shows poor anti-pilling and 5 shows excellent anti-pilling property. Thus the higher the Martindale pilling notes score the more effective the endoglucanase biopolishing treatment.

Note 5: No pilling

Note 4: Slight Pilling

Note 3: Moderate Pilling

Note 2: Distinct Pilling

Note 1: Heavy Pilling

1/2, 1/4 notes are allowed

To make the test result more reliable, 3 separate readings were carried out by different persons for each sample, and the average of the 3 readings was adopted as the final result of pilling notes.

Protein Content

The enzyme protein in a product can be measured with BCA™ Protein Assay Kit (product number 23225, commercial available from Thermo Fisher Scientific Inc.) according to the product manual. Here the protein concentration for Biotouch XC300 was assayed with this method.

For a purified protein sample, the protein concentration of the samples was measured using absorbance at 280 nm. The measurement was performed as follows: the samples were diluted with distilled water by an appropriate factor, then tested at 280 nm for the absorbance with Spectrophotometer UV 1700, with distilled water as blank. Calculations were based: $\epsilon$=46170 $M^{-1}$ $cm^{-1}$ and Molecular weight=28025 g/mol for the purified *Sordaria fimicola* GH45 based on the sequence of the mature protein. The concentration of the enzyme samples were calculated according to Lambert Beers law Abs=$\epsilon \times c \times l$.

Abs represents absorbance at 280 nm.

c represents enzyme concentration.

l represents the length of optical path in standard quartz cuvette.

Example 1

Cloning of the *Sordaria fimicola* GH45 Cellulase (SfCel45) cDNA

Identification and cloning of the Sfcel45 is described in patent WO9629397. The strain *Sordaria fimicola* is available from the American Type Culture Collection ATCC under the accession number ATCC 52644.

The following primer sets were used as PCR primers used for cloning the DNA of sf cel45:

```
KKSC010F(Forward primer):
                                        (SEQ ID NO: 3)
5'-ACACAACTGGGGATCCACCatgcgttcctccactattttgc-3'
```

The underlined portion is the restriction site BamHI which is used to facilitate cloning. The lowercase characters are the Sfcel45 specific sequence beginning with the ATG start codon.

```
KKSC010R(Reverse primer):
                                        (SEQ ID NO: 4)
5'-AGATCTCGAGAAGCTTAttaggcacactggtgatagtaatc
```

The underlined portion of the sequence is a HindIII site which is used to facilitate cloning of the PCR product. The lowercase characters is the reverse complement of the 3' end of the coding region for Sfcel45 including the TAA stop codon.

cDNA Template for Subcloning SfCel45 cDNA of Sf cel45 was cloned according to the protocol described in the article (*a novel method for efficient expression cloning of funal enzyme genes*, Mol Gen Genet (1994) 243: 253-260). The cloned cDNA was directionally inserted into EcoRI-NotI restriction sites of plasmid pYES2.0 (Invitrogen), and the plasmid DNA with insertion was named as pCIC502. Conversely, cDNA from *Sordaria fimicola* may be used as template for the PCR reaction. An additional method to obtain DNA encoding the enzyme Sfcel45 is to create a synthetic gene from the sequence provided in this application (SEQ ID NO: 1). Synthetic genes can be ordered from any of a number of service providers such as Invitrogen, GeneArt (www.invitrogen.com).

1 ng of pCIC502 plasmid DNA was used for the amplification.

iProof High-fidelity 2× Master PCR mix (commercially available from BioRad, Denmark) was used for the amplification. The mix includes polymerase enzyme, dNTPs, salts and buffer in the 2× concentration.

1 ul (microliter) of primer pair (each of KKSC010F and KKSC010R) at 100 pmol/ul concentration were used in a PCR reaction composed of 25 ul of the 2× Master PCR mix, 1 ul of pCIC502 plasmid DNA and 22 ul of $H_2O$ in a final volume of 50 ul. The amplification was performed according to the iProof protocol with an initial denaturation at 98° C. for 30 seconds and then 30 cycles of denaturing at 98° C. for 10 seconds, annealing at 53° C. for 20 seconds, and elongation at 72° C. for 30 seconds; and then a final extension at 72° C. for 10 minutes. The heat block was then programmed to 10° C. until the samples were used.

4 ul from the 50 ul PCR products was run on 1% Tris-Acetate (TAE) agarose gel electrophoresis in 1×TAE buffer. The results showed a single band amplifying at about 880 bp, the expected size for the Sfcel45 coding region. The remaining PCR products were purified with a GFX PCR DNA and Gel Band purification Kit (GE Healthcare, Buckinghamshire, UK).

The In-Fusion Dry-Down PCR Cloning Kit (Clontech Laboratories, Inc., Mountain View, Calif., USA) was used for inserting the purified PCR fragment of Sfcel45 into the *E. coli/Aspergillus* shuttle vector pDau109 (described in WO 2005/042735). The vector was prepared by restricting it with the enzymes BamHI and HindIII and gel purifying the restricted vector with a GFX PCR DNA and Gel Band purification Kit. The Infusion reaction was followed according to the manufacturer's instructions, 2 ul of PCR fragment of Sfcel45 (approximately 50 ugs), and 2 ul of plasmid vector pDau109 (approximately 50 ugs) were used in a total volume of 10 ul, the remaining volume adjusted to 10 ul with deionized water. The reaction was transformed into Fusion blue *E. coli* competent cells (Clontech Laboratories, Inc., Mountain View, Calif., USA) also according to the manufacturer's instructions. Colonies growing under the recommended selection (LB agar with 50 mg/l ampicillin, 37° C. overnight) were identified and 16 colonies were selected for colony PCR.

Colony PCR

The colonies were transferred to fresh LB agar with 50 mg/liter ampicillin with a yellow inoculation pin (Nunc A/S, Denmark) and afterwards twirled directly into the 200 ul PCR tubes consisting of the following solution: 6 ul of 2× HiFI reddy PCR master mix (ABgene; Fermentas GmbH—Part of Thermo Fisher Scientific, Opelstraβe 9 68789 St. Leon-Rot, Germany), 0.5 ul of primer pair for pDau109 (each of Primer 8653 and Primer 8654) at 10 pmol/ul concentration and 5 ul of Deionized $H_2O$ in a final volume of 12 ul. The amplification was performed with initial denaturation at 94° C. for 60 seconds then 30 cycles of denaturing at 94° C. for 30 seconds, annealing at 55° C. for 30 seconds, and elongation at 68° C. for 60 seconds; final extension at 68° C. for 10 minutes. The heat block was then programmed to 10° C. until use.

```
Primer 8653(forward primer):
                                (SEQ ID NO: 5)
5'-GCAAGGGATGCCATGCTTGG-3'

Primer 8654(reverse primer):
                                (SEQ ID NO: 6)
5'-CATATAACCAATTGCCCTC-3'
```

4 ul of the above PCR products were loaded directly on a 1% TAE agarose gel. Those *E. coli* Sfcel45 transformants showing a PCR band of the expected size were selected for plasmid DNA miniprep according to the manufacturer's instructions of Spin miniprep kit (Qiagen, Germany). The selected plasmids with SfCel45 inserts were sequenced with the forward and reverse vector primers used in the colony PCR reaction on an ABI 3700 sequencer (Applied Biosystems, USA) according to the manufacturer's instructions. One PCR error free plasmid was assigned the name P2CF-10 and selected for further work. Plasmid DNA was prepared of P2CF-10 with a Qiagen plasmid midi Kit. The plasmid was eluted in 100 ul TE buffer (10 mM Tris-HCl, 0.1 mM EDTA pH 8.0).

The cDNA and the deduced amino acid sequence of the *Sordaria fimicola* GH45 Cellulase (sf cel45) cDNA is shown in SEQ ID NO: 1 and SEQ ID NO: 2 respectively. The coding sequence is nucleotide 12-896 including the stop codon TAA. The encoded predicted protein is 294 amino acids. Using the SignalP program (Nielsen et al., 1997, *Protein Engineering* 10: 1-6), a signal peptide of 21 residues was predicted, which was further confirmed by the N-terminal sequencing showing mature peptide begins with ASGSGK. The encoded protein contains 294 amino acids with cellulase catalytic domain of amino acids 22 to 237 and cellulose binding domain of amino acid 258 to 294.

Example 2

Expression of the *Sordaria fimicola* GH45 Cellulase cDNA in *Aspergillus oryzae*

The *Aspergillus oryzae* strain MT3568 was used for all experiments. *Aspergillus oryzae* MT3568 is an AMDS (acetamidase) disrupted derivative of JaL355 (WO 2002/40694) in which pyrG auxotrophy was restored in the process of knocking out the *A. oryzae* acetamidase (AMDS) gene. MT3568 protoplasts are prepared according to the method of European Patent, EP0238023, pages 14-15, which are incorporated herein by reference. Fresh protoplast of MT3568 were prepared and used to transform plasmid P2CF-10.

2.5 ug of plasmid DNA P2CF-10 prepared in Example 1 was used for the transformation. The DNA was gently added to 100 ul MT3568 protoplasts and 250 ul of the 60% PEG was then added. The tube was gently mixed and incubated at 37° for 30 minutes. The mix was added to 6 ml of top agar with 10 mM Acetamide and plated on Cove-sorbitol with 10 mM Acetamide.

The plates were incubated at 37° C. for 3 days or more days and then moved to 26° C. for two days. Spores from 8 individual colonies were picked by first dipping a white 10 ul inoculation pin (available from Nunc A/S, Denmark) 0.1% Tween 80 solution, contacting the sporulating colony on the selection plate and restreaking with the pin on fresh selective media (Cove-sorbitol with 10 mM Acetamide). After 5 days at 26° C., the restreaked colonies were used to inoculate a 96 well deep dish plate. Expression was verified on Nu-Page 10% Bis-Tris SDS-PAGE (Invitrogen, Carlsbad, Calif., USA) by Coomassie staining. One transformant was selected for further work and designated as EXP03724.

Example 3

Purification of Recombinant *Sordaria fimicola* GH45 Cellulase from Expression Strain EXP03724

Culture broth of the recombinant *Aspergillus oryzae* EXP03724 was filtered through 0.2 μm (micrometer) PES bottle top filters. The pH of the culture broth was adjusted to 8.0 by using acetic acid. A micro-crystalline cellulose column was packed by re-suspending 50 g Avicel PH101 (Sigma Aldrich) in approximately 300 mL MilliQ water. The slurry was left to set and finer particles were removed by decantation and 300 mL MilliQ water was added. This step was repeated at least three times. The slurry was poured into a column and the slurry was packed at a linear flow rate of 24 cm/h. The Avicel column was equilibrated for at least two column volumes using an equilibration buffer consisting of 25 mM Tris-HCl, pH 7.5. Crude protein was loaded at a linear flow rate of 24 cm/h. Unbound protein was washed out using the equilibration buffer until a stable UV (280 nm) baseline was achieved. Bound protein was eluted using a 1% triethylamine solution and the eluted protein was collected. The pH of the collected protein was immediate adjusted to 7.6. Purity was evaluated using SDS-PAGE (NuPAGE, Invitrogen) and fractions showing bands of the expected apparent molecular weight were pooled.

Collected protein from previous step was further purified using hydrophobic interaction chromatography. Solid ammonium sulphate was gently added to the pool to achieve a final concentration of 1.2 M. The protein was loaded on a Phenyl-Sepharose HP column (GE Healthcare) and equilibrated using the equilibration buffer consisting of 20 mM Tris-HCl, pH 8.0 supplemented with 1.2 M $(NH_4)_2SO_4$. Unbound protein was washed out using the equilibration buffer for at least 2 column volumes. Bound protein was eluted by a linear decreasing gradient of ammonium sulphate (1.2 to 0.0M) generated by the elution buffer consisting of 20 mM Tris-HCl, pH 7.5. The elution step was carried out for 12 column volumes. At the end of the gradient, the remaining protein was eluted by 4 column volumes of elution buffer. 10 mL fractions were collected during the elution procedure. Protein peaks collected during the elution procedure were analyzed on SDS-PAGE and pure fractions were pooled. The buffer was exchanged to 20 mM Tris-HCl, pH 7.5 by using a G-25 gel filtration column (GE Healthcare). The concentration of the desalted sample was determined by measuring absorbance at 280 nm and using the extinction coefficient of 45580 $M^{-1}$ $cm^{-1}$ and molecular weight of 28005 Da calculated from the mature primary sequence using the software GPMAW 7.1

(Lighthouse data, Odense, Denmark). Purification was carried out on an ÄKTA Explorer (GE Healthcare, Uppsala, Sweden) at +4° C.

Example 4

Endoglucanase Activity Assay 0.2% AZCL-HE-cellulose (Megazyme, I-AZCEL) was suspended in 20 mM Bis-Tris buffer of pH 6.0 with addition of 0.01% Triton X-100 by gentle stirring, which was used as a substrate. Then 120 microliter substrate and 30 microliter enzyme sample of 1 mg/ml prepared according to Example 3 were mixed in a Microtiter plate and placed on ice before raction. The assay was initiated by transferring the Microtiter plate to an Eppendorf thermomixer, which was set to the assay temperature of 50° C. The plate was incubated for 20 minutes on the Eppendorf thermomixer at its shaking rate 700 rpm for Microtiter plate. The incubation was stopped by transferring the plate back to the ice bath. Then the plate was centrifuged in an ice cold centrifuge for 5 minutes and 100 microliter supernatant was transferred to a microtiter plate. $OD_{595}$ was read as a measure of endoglucanase activity. All reactions were done with triplicate and a buffer blind without adding any enzyme was included in the assay.

If $OD_{595}$ value of the enzyme sample minus $OD_{595}$ value of the blind is above 0, the enzyme is defined as the enzyme having endoglucanase activity.

$OD_{595}$ value of the *Sordaria fimicola* GH45 Cellulase sample tested in this example minus $OD_{595}$ of the blind was above 0, which shows the *Sordaria fimicola* GH45 cellulase (Sfcel45) in the present invention has the endoglucanase activity.

Example 5

Biopolishing with *Sordaria fimicola* GH45 Cellulase at Different Temperatures in Launder-O-meter The *Sordaria fimicola* GH45 cellulase (mature peptide of SEQ ID NO: 2) purified from Example 3 was tested for biopolishing at different temperatures in the present example, to obtain its temperature curve and assess its flexibility in biopolishing. The commercially available low temperature cellulase product Biotouch XC300 was also included as the benchmark.

Cotton fabric swatches were cut into about 16 cm*16 cm (about 5 grams each). The swatches were placed in the conditioned room (65% humidity, 21° C.) for 24 hours before they were numbered, weighed by the analytical balance and recorded. The biopolishing was conducted in a Launder-O-meter (LOM, SDL-Atlas LP2). Two conditioned swatches and 20 big steel balls (total weight of 220 grams) were placed in each beaker to supply the mechanical aids. The beaker was filled with enzymes and pH 6.5 buffer with 50 mM phosphate prepared as described in media part, wherein the final enzyme concentration with a total volume of around 100 ml was shown in Table 1, which could get a liquid to fabric ratio of about 10:1 (v/w ml/g).

The Launder-O-Meter (LOM) machine was started after the required program as below was chosen, and it would hold when the temperature reached the pre-set temperatures, e.g. 25, 35, 45, 55 or 65° C. At each temperature both enzymes were tested in the same trial. Each beaker was fitted with a lid lined with 2 neoprin gaskets and close tightly with the metal clamping device. The beakers were loaded into the preheated LOM. Metal racks were used to accommodate and secure 5 beakers, in the vertical position, in each of the 4 drum positions. After the treatment at each of the pre-set temperatures for 1 hour, the swatches were removed from the beakers and transferred into the inactivation solution with 2 g/L of sodium carbonate and kept at 85° C. for 10 min. Then the swatches were rinsed in hot water for 2 times and in cold water for 2 times. And they were tumble-dried (AEG, LAVATHERM 37700, Germany) for 1 hour, conditioned for 24 hours at 65% relative humidity, 21° C. prior to evaluation in weight loss and pilling notes.

As summarized in Table 1, in a wide range of temperatures from 25 to 55° C., *Sordaria fimicola* Cel45 cellulase (SfCel45) delivered a good biopolishing performance, which was indicated by both an obvious weight loss and significant improvement in pilling notes. This enzyme showed best performance at 35-45° C. and retained most of its performance in biopolishing at 55 and 25° C. SfCel45 is a good enzyme for biopolishing in low temperature.

The enzyme protein concentration of Biotouch XC 300 used in this example was five times that of the SfCel45. Biotouch XC 300 reaches the significant improvement in pilling note under high enzyme protein, while much lower dosage of SfCel45 could meet the industrial needs. Biotouch XC 300 shows a more sharp temperature curve with its highest performance at 45° C. and substantially lower at 35° C. and 55° C. and very weak at 25° C.

TABLE 1

LOM biopolishing with SfCel45 at pH 6.5, 25-65° C.

| Enzyme | Temperature (° C.) | Weight loss (%) | Pilling notes |
|---|---|---|---|
| 0.064 mg enzyme protein of SfCel45/g fabric | 25 | 0.78 | 3.1 |
| | 35 | 1.64 | 4.4 |
| | 45 | 1.54 | 4.4 |
| | 55 | 0.95 | 4.1 |
| | 65 | −0.17 | 1.0 |
| 0.320 mg enzyme protein of Biotouch XC300/g fabric | 25 | 0.49 | 2.4 |
| | 35 | 1.23 | 3.6 |
| | 45 | 1.62 | 4.1 |
| | 55 | 0.40 | 3.0 |
| | 65 | −0.16 | 1.1 |

Example 6

Biopolishing with *Sordaria fimicola* GH45 at Different pHs, 35° C. In Launder-O-Meter The *Sordaria fimicola* GH45 cellulase (mature peptide of SEQ ID NO: 2) purified from Example 3 was tested for biopolishing at different pHs in the present example, to investigate its pH curve and assess its flexibility in biopolishing.

The fabric preparation and trial operation was similar to those in Example 5 except that the trial was conducted at 35° C. with different pHs prepared as described in media part.

As summarized in Table 2, in the trial at 35° C., SfCel45 delivered a good biopolishing performance in a wide range of pHs from 5 to 7.5, as indicated by both an obvious weight loss and improvement in pilling notes. In the wide range of pHs, this enzyme increased the pilling notes by 1.5-2.3, a significant improvement as compared to the blank sample (without enzyme). This enzyme showed best performance at pH 6-6.5 and can also work in a broad pH range from 5 to 7.5.

TABLE 2

LOM biopolishing with SfCel45 at pH 5-7.5, 35° C.

| Enzyme | pH | Weight loss (%) | Pilling notes |
|---|---|---|---|
| Blank | 6.5 | 0.00 | 1.5 |
| 0.051 mg enzyme protein of SfCel45/g fabric | 5.0 | 0.53 | 3.0 |
| | 6.0 | 0.77 | 3.8 |
| | 6.5 | 0.89 | 3.4 |
| | 7.5 | 0.50 | 3.1 |

Example 7

Biopolishing with *Sordaria fimicola* GH45 and Cellusoft CR with or without Salts/Dyestuff in Launder-O-Meter In a classical dyeing process with reactive dyestuff, salts like $Na_2SO_4$ or NaCl are loaded at high dosage to aid the dyeing. So a cellulase product to be applied in the dyeing bath should be compatible with salts and dyestuff to maximize the enzyme potential. Here, the SfCel45 (mature peptide of SEQ ID NO: 2) purified from Example 3 was tested for biopolishing in the present example. The product Cellusoft CR was included as the benchmark.

The fabric preparation and trial operation was similar to Example 5 except that in this example the beaker was filled with enzymes and/or dyestuff solutions and salts were included in some selected beakers according to Table 3 and the trial was conducted at pH 6.5, 35° C., wherein the temperature of 35° C. is suitable for both Cellusoft CR and the SfCel45.

The product Cellusoft CR was dosed at 1.4% on weight of fabric since such dosage reached the similar level of weight loss and pilling note of 1.37% and 4.1 respectively as those of 1.10 and 3.8 respectively resulted from 0.096 mg *Sordaria fimicola* GH45/g fabric.

As summarized in table 3, SfCel45 works efficiently in biopolishing at pH 6.5, 35° C., at the presence of high concentration of salts and dyestuff. The presence of salts even boosted the biopolishing of SfCel45 to some extent. So SfCel45 is a cellulase with good compatibility with salt and dyestuff during dyeing step.

TABLE 3

LOM biopolishing with SfCel45 and Cellusoft CR at pH 6.5, 35° C.

| Enzyme | Enzyme dosage | Salts | dyestuff | Weight loss(%) | Pilling notes |
|---|---|---|---|---|---|
| Blank | None | None | None | 0.00 | 1.5 |
| SfCel45 | 0.096 mg enzyme protein/g fabric | None | None | 1.10 | 3.8 |
| | | 80 g/L $Na_2SO_4$ | None | 1.35 | 4.4 |
| | | 80 g/L NaCl | None | 1.32 | 4.0 |
| | | 80 g/L $Na_2SO_4$ | 5% Black 5 | 1.31 | 3.6 |
| | | 80 g/L $Na_2SO_4$ | 5% Red 195 | 0.71 | 2.9 |
| Cellusoft CR | 1.40% product on weight of fabric | None | None | 1.37 | 4.1 |
| | | 80 g/L $Na_2SO_4$ | None | 0.33 | 2.6 |
| | | 80 g/L NaCl | None | 0.71 | 3.4 |
| | | 80 g/L $Na_2SO_4$ | 5% Black 5 | 0.32 | 2.4 |
| | | 80 g/L $Na_2SO_4$ | 5% Red 195 | 0.31 | 2.5 |

The invention described and claimed herein is not to be limited in scope by the specific aspects herein disclosed, since these aspects are intended as illustrations of several aspects of the invention. Any equivalent aspects are intended to be within the scope of this invention. Indeed, various modifications of the invention in addition to those shown and described herein will become apparent to those skilled in the art from the foregoing description. Such modifications are also intended to fall within the scope of the appended claims. In the case of conflict, the present disclosure including definitions will control.

SEQUENCE LISTING

```
<160> NUMBER OF SEQ ID NOS: 6

<210> SEQ ID NO 1
<211> LENGTH: 1048
<212> TYPE: DNA
<213> ORGANISM: Sordaria fimicola

<400> SEQUENCE: 1

caagatacaa tatgcgttcc tccactattt tgcaaaccgg cctggtggcc gttctcccct     60

tcgccgtcca ggccgcctca ggatccggca agtccaccag atattgggac tgctgcaaac    120

catcttgtgc ctggtccggc aaggcttctg tcaaccgccc tgttctcgcc tgcgacgcaa    180

acaacaaccc gctgaacgac gccaacgtca agtcaggatg tgatggcggt tctgcataca    240

cctgtgccaa caactctccc tgggcagtga atgacaatct ggcctacggc ttcgcggcca    300

cgaaactcag cgggggggacc gagtcatctt ggtgctgcgc ctgttatgcc ctcacattca    360

catcgggtcc tgtttctggc aagaccttgg ttgtccagtc taccagtacc ggtggtgatc    420

ttggctctaa tcatttcgat ctcaacatgc ccggcggagg cgttggccta tttgacggtt    480

gtaaacggga gtttggcggt ctccccggcg cccaatacgg cggcatcagc tctcgcagcg    540

agtgcgactc cttcccggcc gctcttaagc ccggctgcca gtggcgcttc gactggttca    600

agaacgccga caacccggag ttcaccttca agcaggtcca atgcccgtcc gagcttacct    660
```

```
cccgcaccgg ctgcaagcga aacgacgact cccagttccc ggcttttact cctccttctg    720

gtggaggcag caacccctct actccgacaa ctcctccctc ttctggcggc ggcggctccg    780

gatgtgctgc ggctatgtac gctcagtgtg gcggctcagg attttctggt tgcaccaatt    840

gcccatctgg atcgacctgc aaggccatca atgattacta tcaccagtgt gcctaagtag    900

tgccaagtgg tatgcggggt tgtggtgtct cgaattgaga gtagggaccg gctaaaaggg    960

atcggtagag agcacatcct tcaagtacaa tctcatactg ctgtgggcat tttgtttatc   1020

caaaaaaaaa aaaaaaaaaa aaaaaaaa                                      1048


<210> SEQ ID NO 2
<211> LENGTH: 294
<212> TYPE: PRT
<213> ORGANISM: Sordaria fimicola

<400> SEQUENCE: 2

Met Arg Ser Ser Thr Ile Leu Gln Thr Gly Leu Val Ala Val Leu Pro
1               5                   10                  15

Phe Ala Val Gln Ala Ala Ser Gly Ser Gly Lys Ser Thr Arg Tyr Trp
            20                  25                  30

Asp Cys Cys Lys Pro Ser Cys Ala Trp Ser Gly Lys Ala Ser Val Asn
        35                  40                  45

Arg Pro Val Leu Ala Cys Asp Ala Asn Asn Asn Pro Leu Asn Asp Ala
    50                  55                  60

Asn Val Lys Ser Gly Cys Asp Gly Gly Ser Ala Tyr Thr Cys Ala Asn
65                  70                  75                  80

Asn Ser Pro Trp Ala Val Asn Asp Asn Leu Ala Tyr Gly Phe Ala Ala
                85                  90                  95

Thr Lys Leu Ser Gly Gly Thr Glu Ser Ser Trp Cys Cys Ala Cys Tyr
            100                 105                 110

Ala Leu Thr Phe Thr Ser Gly Pro Val Ser Gly Lys Thr Leu Val Val
        115                 120                 125

Gln Ser Thr Ser Thr Gly Gly Asp Leu Gly Ser Asn His Phe Asp Leu
    130                 135                 140

Asn Met Pro Gly Gly Gly Val Gly Leu Phe Asp Gly Cys Lys Arg Glu
145                 150                 155                 160

Phe Gly Gly Leu Pro Gly Ala Gln Tyr Gly Gly Ile Ser Ser Arg Ser
                165                 170                 175

Glu Cys Asp Ser Phe Pro Ala Ala Leu Lys Pro Gly Cys Gln Trp Arg
            180                 185                 190

Phe Asp Trp Phe Lys Asn Ala Asp Asn Pro Glu Phe Thr Phe Lys Gln
        195                 200                 205

Val Gln Cys Pro Ser Glu Leu Thr Ser Arg Thr Gly Cys Lys Arg Asn
    210                 215                 220

Asp Asp Ser Gln Phe Pro Ala Phe Thr Pro Pro Ser Gly Gly Gly Ser
225                 230                 235                 240

Asn Pro Ser Thr Pro Thr Thr Pro Pro Ser Ser Gly Gly Gly Gly Ser
                245                 250                 255

Gly Cys Ala Ala Ala Met Tyr Ala Gln Cys Gly Gly Ser Gly Phe Ser
            260                 265                 270

Gly Cys Thr Asn Cys Pro Ser Gly Ser Thr Cys Lys Ala Ile Asn Asp
        275                 280                 285

Tyr Tyr His Gln Cys Ala
    290
```

```
<210> SEQ ID NO 3
<211> LENGTH: 41
<212> TYPE: DNA
<213> ORGANISM: Artificial Sequence
<220> FEATURE:
<223> OTHER INFORMATION: Synthetic Construct

<400> SEQUENCE: 3

acacaactgg ggatccacca tgcgttcctc cactattttg c                          41


<210> SEQ ID NO 4
<211> LENGTH: 41
<212> TYPE: DNA
<213> ORGANISM: Artificial Sequence
<220> FEATURE:
<223> OTHER INFORMATION: Synthetic Construct

<400> SEQUENCE: 4

agatctcgag aagcttatta ggcacactgg tgatagtaat c                          41


<210> SEQ ID NO 5
<211> LENGTH: 20
<212> TYPE: DNA
<213> ORGANISM: Artificial Sequence
<220> FEATURE:
<223> OTHER INFORMATION: Synthetic Construct

<400> SEQUENCE: 5

gcaagggatg ccatgcttgg                                                  20


<210> SEQ ID NO 6
<211> LENGTH: 19
<212> TYPE: DNA
<213> ORGANISM: Artificial Sequence
<220> FEATURE:
<223> OTHER INFORMATION: Synthetic Construct

<400> SEQUENCE: 6

catataacca attgccctc                                                   19
```

The invention claimed is:

1. A method for treating a textile, comprising contacting the textile with a polypeptide having endoglucanase activity at a temperature in the range of 15-65° C., wherein the polypeptide has at least 96% sequence identity to residues 22-294 of the polypeptide of SEQ ID NO: 2.

2. The method of claim 1, wherein the polypeptide has at least 97% sequence identity to residues 22-294 of the polypeptide of SEQ ID NO: 2.

3. The method of claim 1, wherein the polypeptide has at least 98% sequence identity to residues 22-294 of the polypeptide of SEQ ID NO: 2.

4. The method of claim 1, wherein the polypeptide has at least 99% sequence identity to residues 22-294 of the polypeptide of SEQ ID NO: 2.

5. The method of claim 1, wherein the polypeptide is residues 22-294 of the polypeptide of SEQ ID NO: 2.

6. The method of claim 1, wherein the polypeptide is a fragment of residues 22-294 of the polypeptide of SEQ ID NO: 2 that has endoglucanase activity.

7. The method of claim 1, wherein the polypeptide is a *Sordaria* polypeptide.

8. The method of claim 1, wherein the polypeptide is a *Sordaria fimicola* polypeptide.

9. The method of claim 1, wherein the method is conducted at a pH in the range of 4 to 8.

10. The method of claim 1, wherein the method is applied in a biopolishing process.

11. The method of claim 10, which further comprises contacting the textile with a catalase, wherein the treatment with the catalase and the treatment with the polypeptide having endoglucanase activity are performed sequentially or simultaneously in the same bath.

12. The method of claim 10, which further comprises incubating the textile for 10 minutes to 1 hour after adding a dyestuff, and later supplementing the solution with a salt.

13. The method of claim 12, wherein the salt is NaCl or $Na_2SO_4$.

14. The method of claim 1, which further comprises contacting the textile with a dyestuff, wherein the dyestuff and the polypeptide having endoglucanase activity are added sequentially or simultaneously into the same bath containing the textile.

15. The method of claim 14, wherein the polypeptide having endoglucanase activity is added prior to the dyestuff.

16. The method of claim 14, wherein the dyestuff is a reactive dye.

17. The method of claim 1, wherein the method is applied in a biostoning process.

* * * * *